US007011500B2

(12) United States Patent
Matson

(10) Patent No.: US 7,011,500 B2
(45) Date of Patent: Mar. 14, 2006

(54) ROLLING BARREL FAN

(75) Inventor: Carl G. Matson, Jacksonville, AR (US)

(73) Assignee: Triangle Engineering of Arkansas, Inc., Jacksonville, AR (US)

( * ) Notice: Subject to any disclaimer, the term of this patent is extended or adjusted under 35 U.S.C. 154(b) by 104 days.

(21) Appl. No.: 10/756,955

(22) Filed: Jan. 15, 2004

(65) Prior Publication Data

US 2005/0158167 A1 Jul. 21, 2005

(51) Int. Cl.
*F04D 13/06* (2006.01)

(52) U.S. Cl. ..... 416/63; 416/247 R; 415/121.2

(58) Field of Classification Search ..... 416/63, 416/247 R; 415/121.2; 417/234
See application file for complete search history.

(56) References Cited

U.S. PATENT DOCUMENTS 2,633,293 A * 3/1953 Jones ..... 417/234
3,809,503 A * 5/1974 Schlicker et al. ..... 415/121.2
4,239,459 A * 12/1980 Felter ..... 417/234
5,441,391 A * 8/1995 Frost et al. ..... 417/362
5,480,282 A 1/1996 Matson
5,616,172 A * 4/1997 Tuckerman et al. ..... 96/16
5,749,708 A 5/1998 Matson
5,944,488 A 8/1999 Matson
5,951,257 A 9/1999 Matson
6,074,182 A 6/2000 Matson
6,190,140 B1 2/2001 Matson

* cited by examiner

*Primary Examiner*—Edward K. Look
*Assistant Examiner*—Igor Kershteyn
(74) *Attorney, Agent, or Firm*—Stephen D. Carver

(57) ABSTRACT

A ventilation fan that functions as a wheel for movements. The generally cylindrical fan housing is pivotally coupled to a triangular handle. The handle may be manually grasped to roll the fan towards an operative position. The handle may be positioned in a temporary storage position, and an inverted, operative position where the drum is elevated for stable use. The drum-shaped fan rolls on its own, and the fan radius becomes the rolling radius. The preferred handle is attached to suitable bearings secured to the guards at the center of each side of the fan. When the destination is reached, the handle is deployed upside-down to function as a support stand, and the fan remains in a stable orientation without moving or shifting its position during operation.

7 Claims, 16 Drawing Sheets

ROLLING BARREL FAN

BACKGROUND OF THE INVENTION

I. Field of the Invention

The present invention relates generally to industrial ventilation fans. More particularly, the present invention relates to cylindrical, barrel fans for providing high-volume ventilation, and to a structural adaptation for moving them.

II. Description of the Prior Art

Known prior art fans are available in many different sizes, configurations, and power ratings. High volume barrel fans shaped like cylinders are well known in the art. Typical barrel fans find wide application within industrial environments for providing auxiliary ventilation. These fans are especially useful in factory areas that are not cooled with conventional air-conditioning apparatus. Barrel fans are also used widely for ventilation applications in diverse agricultural settings, especially in the poultry and dairy industries. Typical high volume barrel fans control the direction, velocity, and volume of air being moved.

High volume ventilation fans include a rigid housing that protectively encloses the fan, its blade, and the internal drive-motor. Protective guards usually shroud the housing. So-called "box fans" have a tubular housing that is "square," i.e., in the general form of a cube or parallelepiped. So-called "barrel fans" are characterized by tubular, drum-shaped housings, in the shape of a cylinder or tube. Barrel fins may have direct-drive motor-fan combinations, or with common "tube axle" designs, the drive motor may be coupled to the propeller with a flexible drive belt. Depending upon the chosen design and configuration of a given fan, different accessory items such as screen guards, shutters, electrical controls, discharge cones, and specially-configured venturis may be deployed. Typical high capacity fans may be mounted on the ground, or secured in an elevated position upon a rigid support. The two principal fan-drive designs employed with modern high capacity fans, namely direct drive and belt-driven or tube-axle systems, have various advantages and disadvantages known in the art.

Because of their size and weight, these fans may be difficult to quickly or conveniently move to an operation position. In a factory setting, the fans may be manually moved about during a typical day between various locations. Usually they are manually moved about over smooth concrete surfaces, and some designs have handles for easing gripping tasks. Further, some large fan designs include wheels attached beneath their housing that facilitate movements. However, fork lifts or hoists are often necessary.

Typical fan wheel assemblies are rather small, compared to the dimensions of the standard barrel fan, and movements with them are sometimes difficult. For example, fins used outdoors upon golf courses need wheels with a large rolling radius. When grasped by their handles and moved over rough, uneven terrain, designs using inadequately-sized wheels are difficult to move and position without skidding. Some heavy duty fans intended for use in mines or oil fields include skids that enable them to be moved with power equipment.

Many industrial fans comprise a multi-bladed propeller that is driven at a high velocity. In response to the significant air flow generated by such fans, precession occurs, and the inappropriately-braced housing may move along the hard supporting surface in a haphazard manner. Another cause of fan vibration relates to the "V-belts" or drive belts. In such fans the blade tip speed must be less than approximately one hundred miles per hour to minimize noise. Typically the fan speed is reduced from the motor speed by a ratio of three to one. This gear reduction results from the pulleys of various sizes that are interconnected with the V-belt. Over time typical V-belts will eventually wear and deform. Thereafter the tension transmitted by the belt between the axis of rotation of the fan blade and the drive motor axis will vary in response to rotation. Unwanted vibration results, shaking the fan and adding to the noise level. Furthermore, vibration intensity generally increases over time. Many fans of this type lack an adequate stand that dependably braces it against vibration and resultant movements. Thus, once moved to the desired ventilation site, typical wheeled designs vibrate, often shifting and moving about.

Direct drive ventilation fans tend to vibrate less. The motors used in direct drive fans turn at a slower speed than motors in belt-driven systems. For example, to obtain the correct blade speed for a thirty-six inch fan the direct drive motor should turn at approximately 850 RPM. The conventional belt-driven fan, comprising a capacitor-start motor turning approximately 1750 RPM, requires two pulleys to divide the fan speed range down to approximately 500–800 RPM. Direct drive systems eliminate the complex speed reduction system and can thus reduce vibration and wear. However, the mounting systems for direct drive systems must adequately support the center of the torque moment. Often a plurality of isolation mounts located in a circular pattern help maintain shaft alignment and absorb torsional shocks. All of these adaptations raise the overall weight of the fan, and make transportation and deployment more difficult.

I have previously invented various fans with one or more of the characteristics discussed above. For example, my prior U.S. Pat. No. 5,480,282, issued Jan. 2, 1996, discloses a high-velocity cooling fan for moving large volumes of air relatively long distances. A generally U-shaped yoke, rolled from welded, nested channels, pivotally mounts the fan in a semi-permanent location upon a rigid, vertically upright post.

In prior U.S. Pat. No. 5,944,488 I have disclosed a tube axle fan assembly with deformable, convex guards that removably snap fit. The cylindrical, hollow housing is ideal for modifications according to the instant invention.

My prior U.S. Pat. No. 5,951,25, issued Sep. 14, 1999, shows a "square" fan. A parallelepiped housing protectively encloses an internal subframe securing a drive motor and fan propeller.

My U.S. Pat. No. 6,074,182, issued Jun. 13, 2000, discloses a direct drive cooling fan with a special X-shaped mounting system for securing the drive motor. The mounting chassis comprises a pair of complimentary brackets welded at opposite sides of the drive motor shell. The brackets comprise a curved, interior cradle that flushly mates with the circumferential periphery of the drive motor. The diametrically aligned cradle wings form an X-shaped profile with the motor at the center.

Finally, my U.S. Pat. No. 6,190,140, issued Feb. 20, 2001, discloses a belt-driven fan with a tension-preserving motor mounting means. In one form of the invention the housing is cylindrical.

Numerous difficulties can be encountered when moving a ventilation fan about through normal means. In response, I have developed a barrel fan whose large rolling radius makes movement easy. The design is easily moved about outdoors over grass and various obstacles without power equipment, lifts, or hoists. Once the intended location is reached, the fan stand is deployed to secure the fan in a proper operative position that resists vibration and movement during subsequent use.

SUMMARY OF THE INVENTION

This invention provides an easily-transported, high volume fan that is simply rolled into place, and then semi-permanently positioned on a self-contained stand.

The relatively large, generally cylindrical body of the barrel fan functions as a wheel, allowing the fan to be rolled to a desired operating location. Thus, small-diameter auxiliary rolling wheels are not necessary. The large, drum-shaped fan thus rolls on its own, and the rolling radius is provided by the circular fan cross section.

The preferred, somewhat V-shaped handle is attached to suitable bearings at the center of each side of the fan. When the destination is reached, the handle is deployed "upside-down" to function as a stand or base, and the fan remains in a stable orientation without moving or shifting position. The very large foot-print resulting from this construction avoids surface damage as the fan is moved. Preferably, resilient tires are attached about the circumference of the fan housing.

Preferably the power plug is recessed in suitable structure mounted near the internal drive motor. A similarly-recessed stop-start switch is mounted radially opposite the position of the plug. To roll the fan, the power cord is simply unplugged, and the fan rolls along without tangling wires.

Thus a basic object is to provide an easily-moved, high capacity ventilation fan.

Another fundamental object is to provide a high-volume, heavy-weight ventilation fan that can be easily moved about and deployed by a single person without special tools or power equipment.

A further object is to provide a high-volume ventilation fan of the general character described that, once moved to a desired location, remains in a stable orientation without moving or shifting position.

Another basic object is to make a large, drum shaped fan roll on its own, so that auxiliary support wheels and associated axle and bearing structures are unnecessary.

A similar object is to eliminate the need for auxiliary wheel systems on large barrel fans.

Another basic object is to ease the burden on the workers who must position and orient ventilation fans in various locations at a typical work place during the day.

A further important object is to provide a barrel fan of the character described with a convenient handle that not only aids in manipulation and transportation, but doubles as a dependable stand for the fan once the target location for fan deployment is reached.

Yet another object is to enable a relatively large, heavy-weight barrel fan to be hand-moved over rough outdoor terrain, such as that encountered at golf courses, without leaving unsightly tracks or otherwise defacing or marring the turf.

A still further object of my invention is to simplify the deployment and operation of portable ventilation fans of the type commonly used in industrial environments.

Yet another object is to provide a portable barrel fan design of the character described that integrates efficiently with either direct-drive or belt-driven designs.

Another basic object is to provide a design of the character described that integrates a convenient electrical power plug connection into the design to readily facilitate connection and disconnection of electric power.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
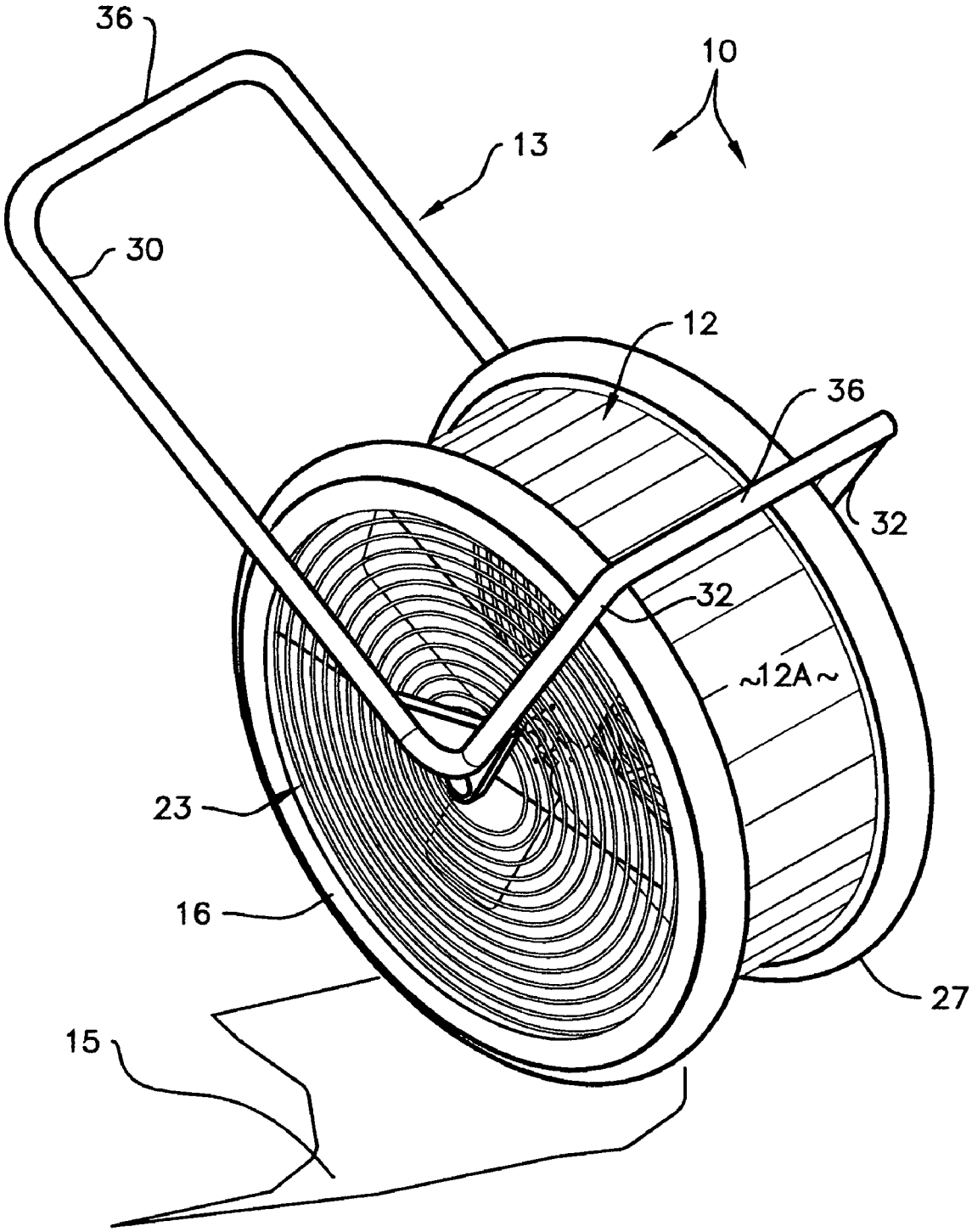
FIG. 1 is an isometric view of my new rolling barrel fan disposed in the rolling or transportation mode, with portions broken away for brevity.

With initial reference now directed to the appended drawings, the preferred rolling barrel fan has been generally designated by the reference numeral 10. Numerous pertinent design details pertinent to motor mounting, propeller drive systems, and other internal constructional details are discussed in my prior U.S. Pat. Nos. 5,480,282, 5,944,488, and 6,047,182, which, for purposes of disclosure, are hereby incorporated by reference. It is to be understood that various types of fan designs, including tube axle fans, direct drive fans, and other design types may be used with the invention.

In the best mode, the rigid, tubular, drum-shaped housing 12 is in the general form of a barrel, which is characterized by a round cross section. The drum mounts a handle, generally designated by the reference numeral 13, which enables the fan to be rolled to a given location over a supporting surface 15 (FIG. 1). As explained in detail hereinafter, handle 13 doubles as a support stand for disposing the fan in an operative position once the job site is reached.

Figure 3:
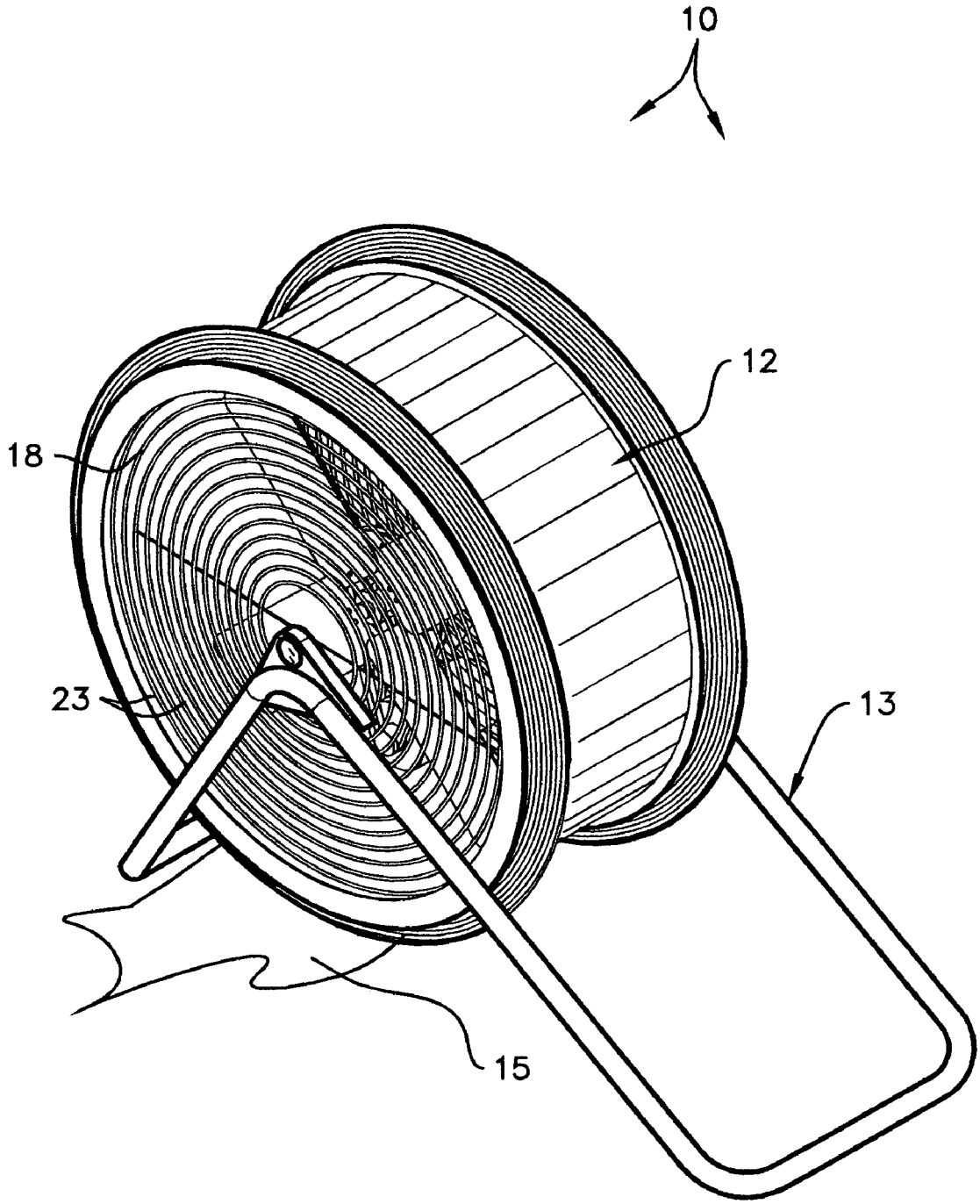
FIG. 3 is an isometric view similar to FIGS. 1 and 2 but showing the fan semi-permanently disposed in an operative ventilating orientation.
Figure 9:
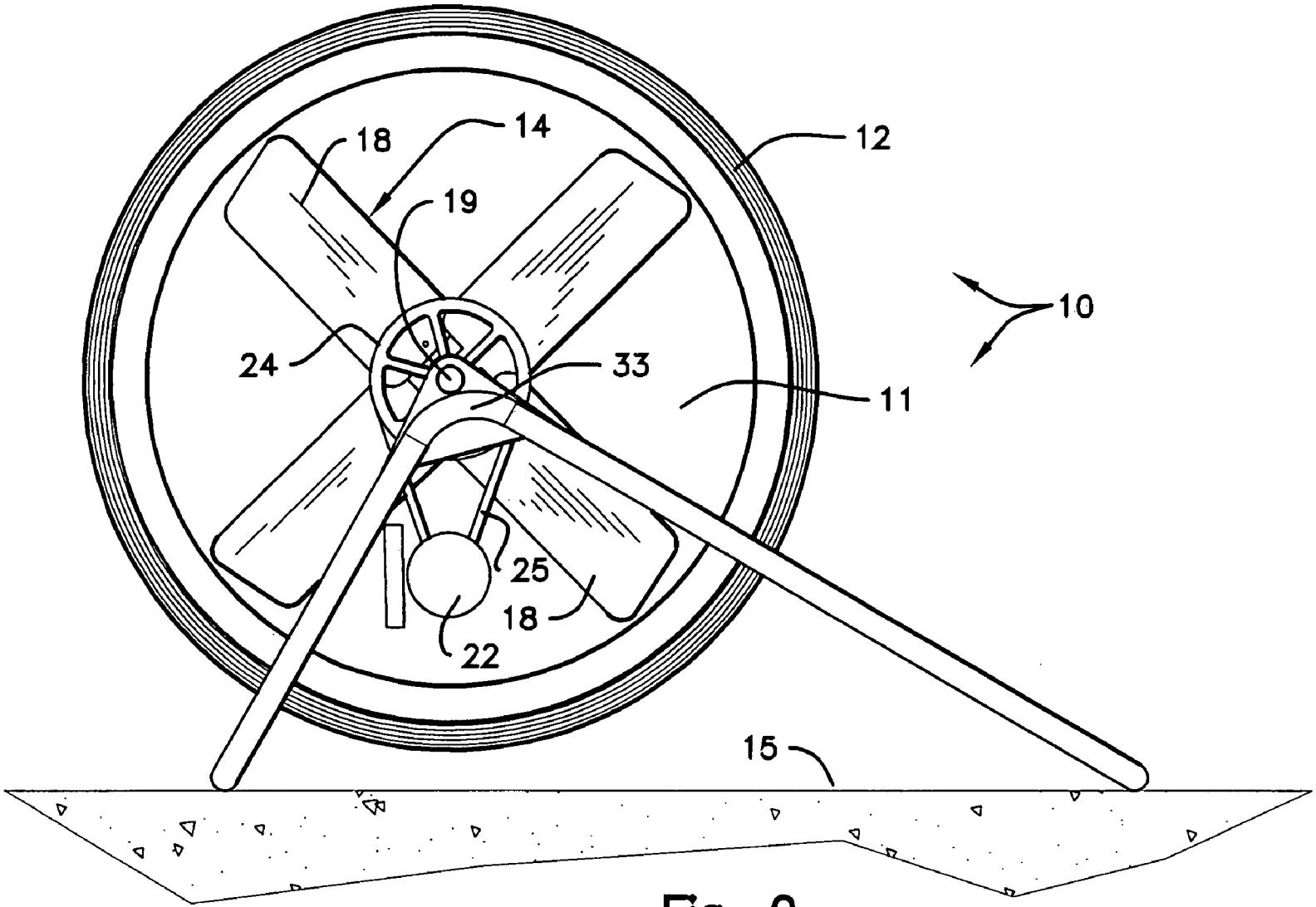
FIG. 9 is an enlarged, fragmentary side elevational view of the fan disposed in an operative position similar to FIG. 8, with portions thereof broken away or shown in section for clarity.
Figure 11:
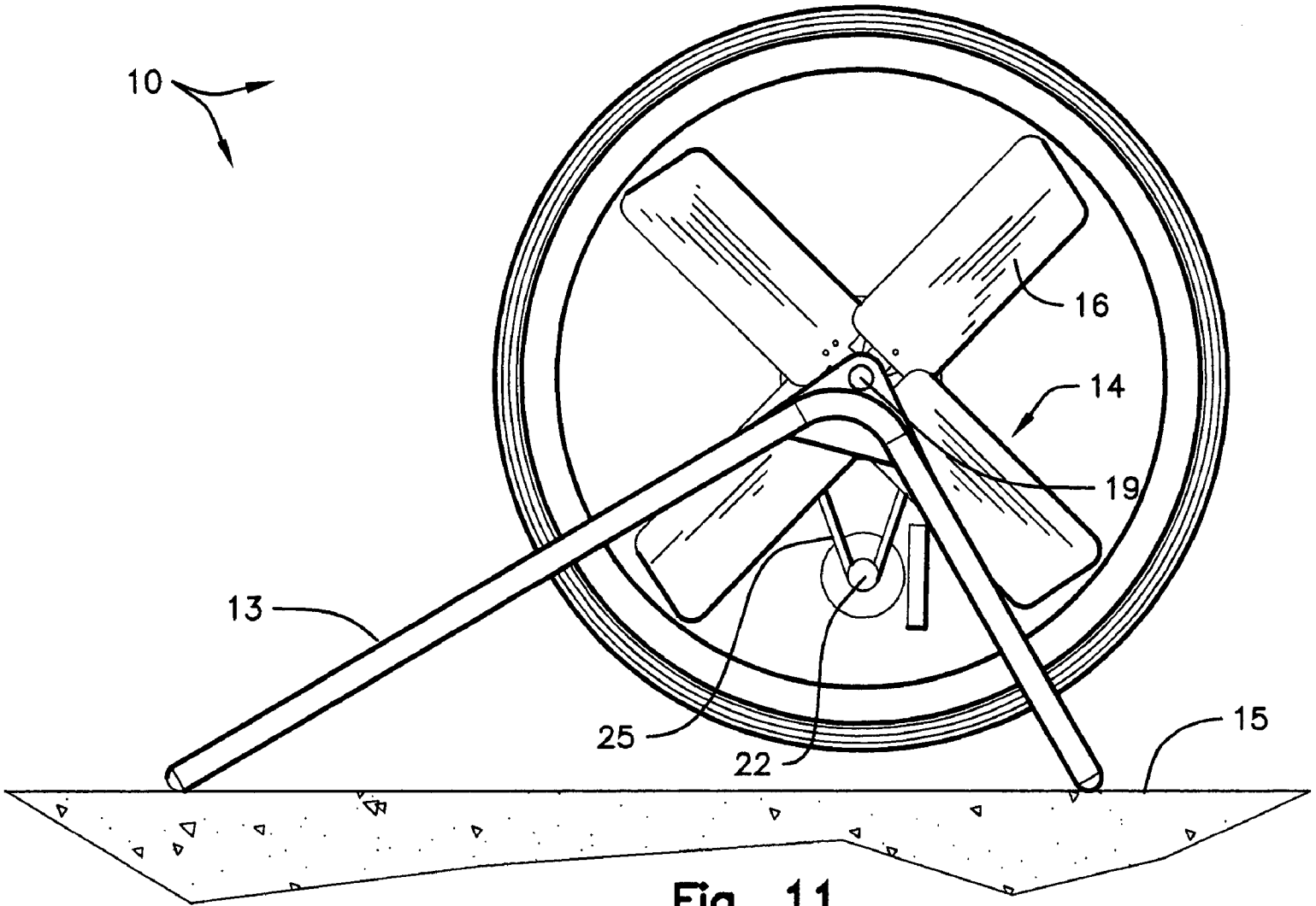
FIG. 11 is an enlarged, fragmentary elevational view similar to FIG. 9, but showing the opposite side.
Figure 12:
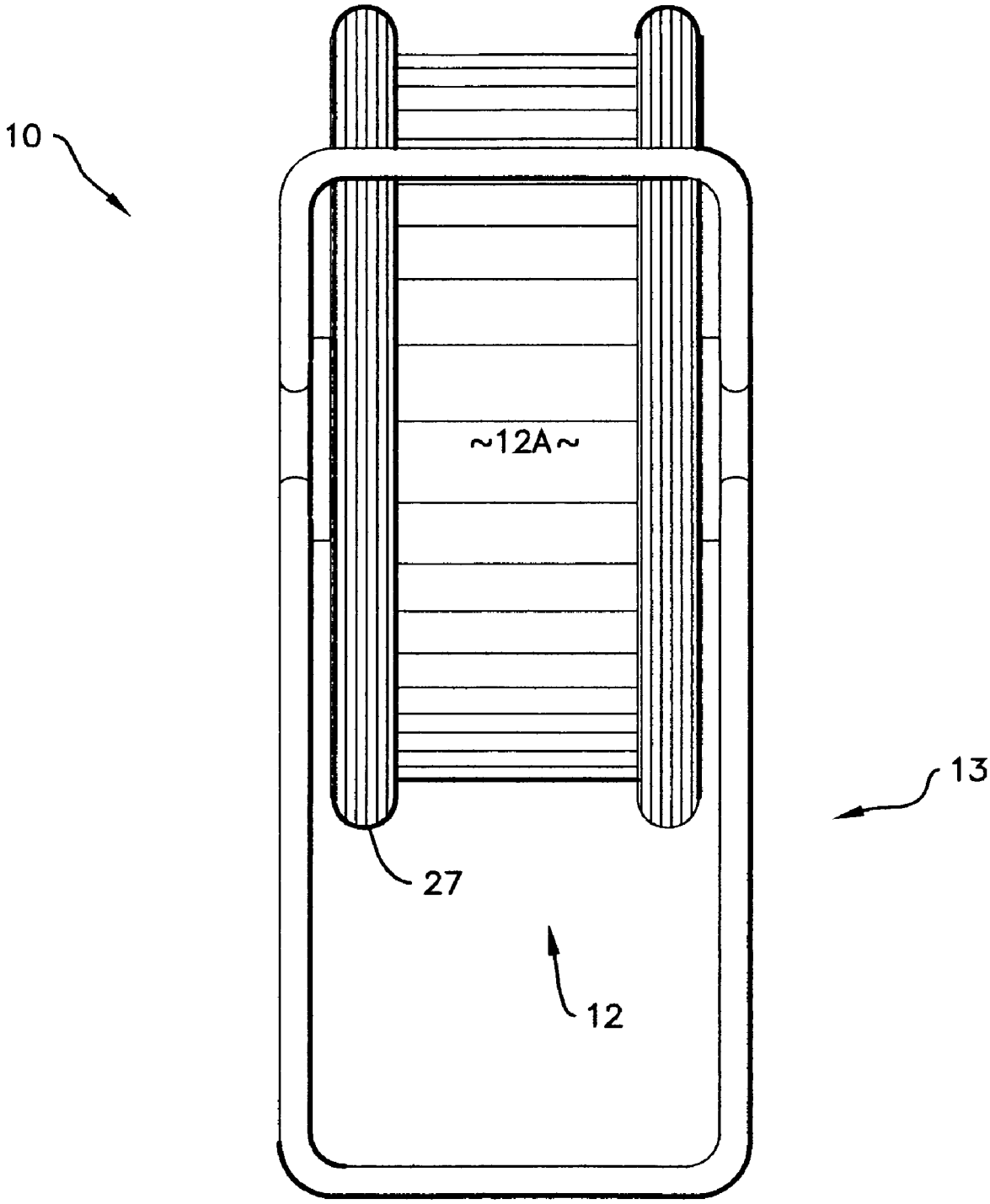
FIG. 12 is a top plan view of the fan of FIG. 1.
Figure 13:
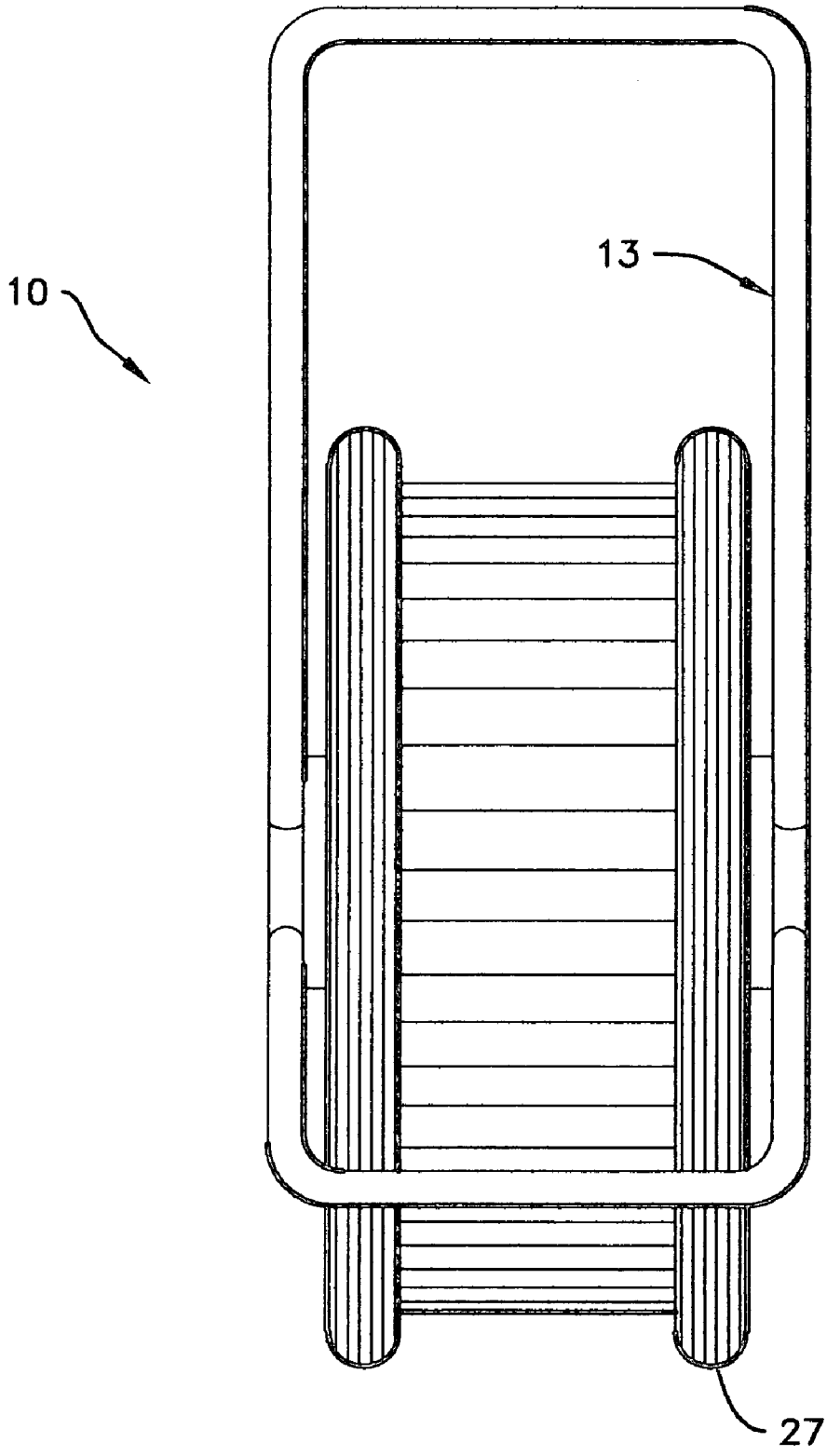
FIG. 13 is a bottom plan view of the fan as it appears in FIG. 3.
Figure 14:
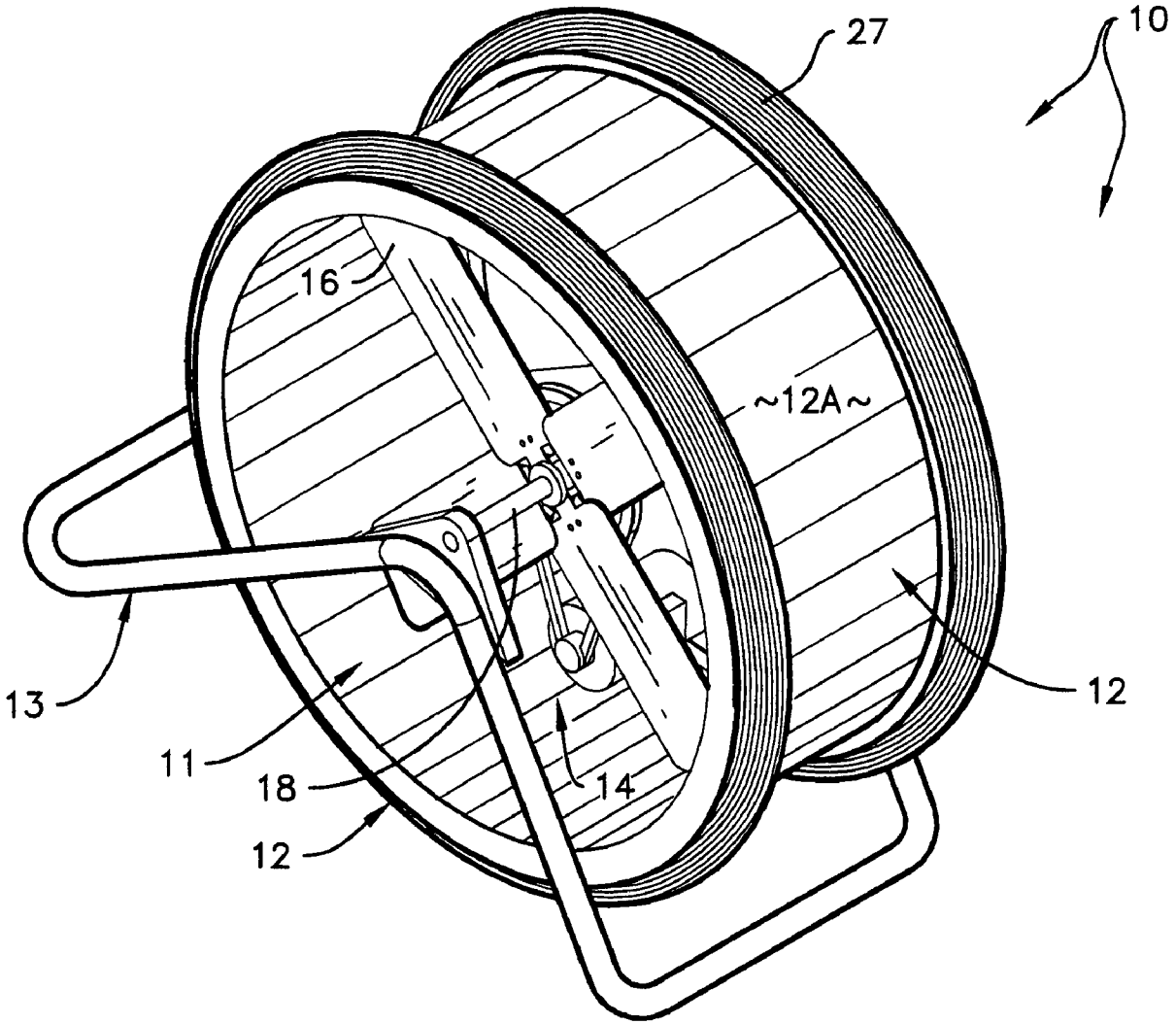
FIG. 14 is a frontal isometric view of a deployed fan, with portions thereof broken away for clarity or omitted for brevity.
Figure 15:
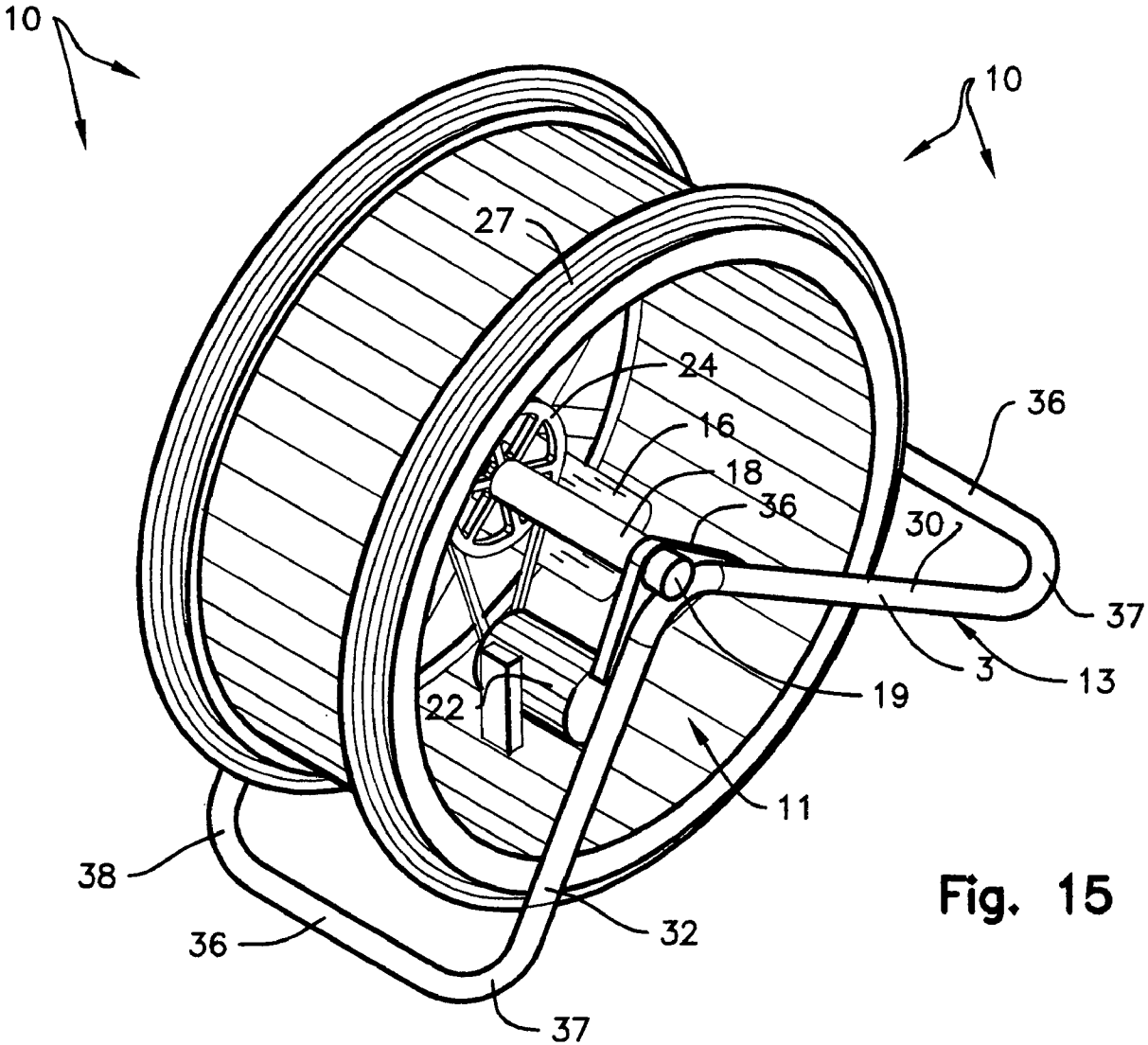
FIG. 15 is a rear isometric view of a deployed fan, with portions thereof broken away for clarity or omitted for brevity; and, FIG. 16 is a vertical sectional view.
Figure 16:
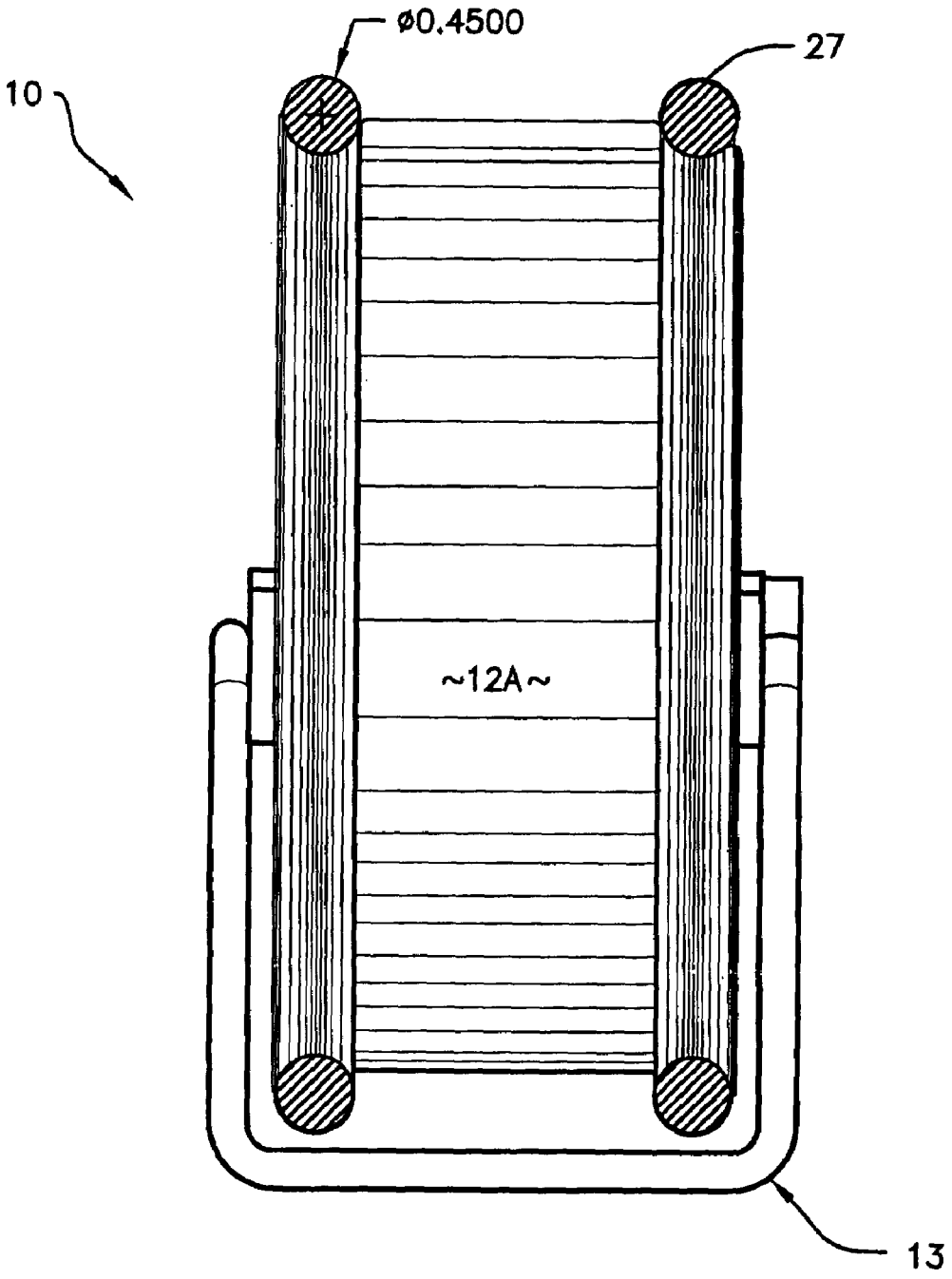

A conventional, rotatable propeller 14 (FIGS. 9, 11) is operatively disposed concentrically within the interior 11 (FIG. 14) of housing 12. Propeller 14 has a plurality of individual, radially spaced-apart blades 16 whose number and pitch are constructed in accordance with well known standards in the art. The propeller axle (not shown) is journalled for rotation within a suitable mandrel 18 (FIG. 15), and a center of rotation is generally established at 19 (FIG. 15). A conventional electric motor 22 (FIGS. 9, 15) that drives the propeller 14 is coupled to drive sprocket 24 via belt 25 (FIG. 9). Preferably motor 22 is mechanically positioned such that it is below the center of rotation 19 when the fan is disposed for operation as illustrated in FIGS. 3, 9, and 15. In other words, for stability, it is preferred that the motor be mounted such that it is as close as reasonably possible to supporting surface 15 (FIGS. 1, 9) when positioned for operation. However, a direct-drive motor may be satisfactorily employed with my new "rolling barrel" design concept. Suitable motor mounting techniques for direct drive fans are described and illustrated in one or more of my above-mentioned U.S. patents, which are incorporated by reference for disclosure purposes.

Figure 10:
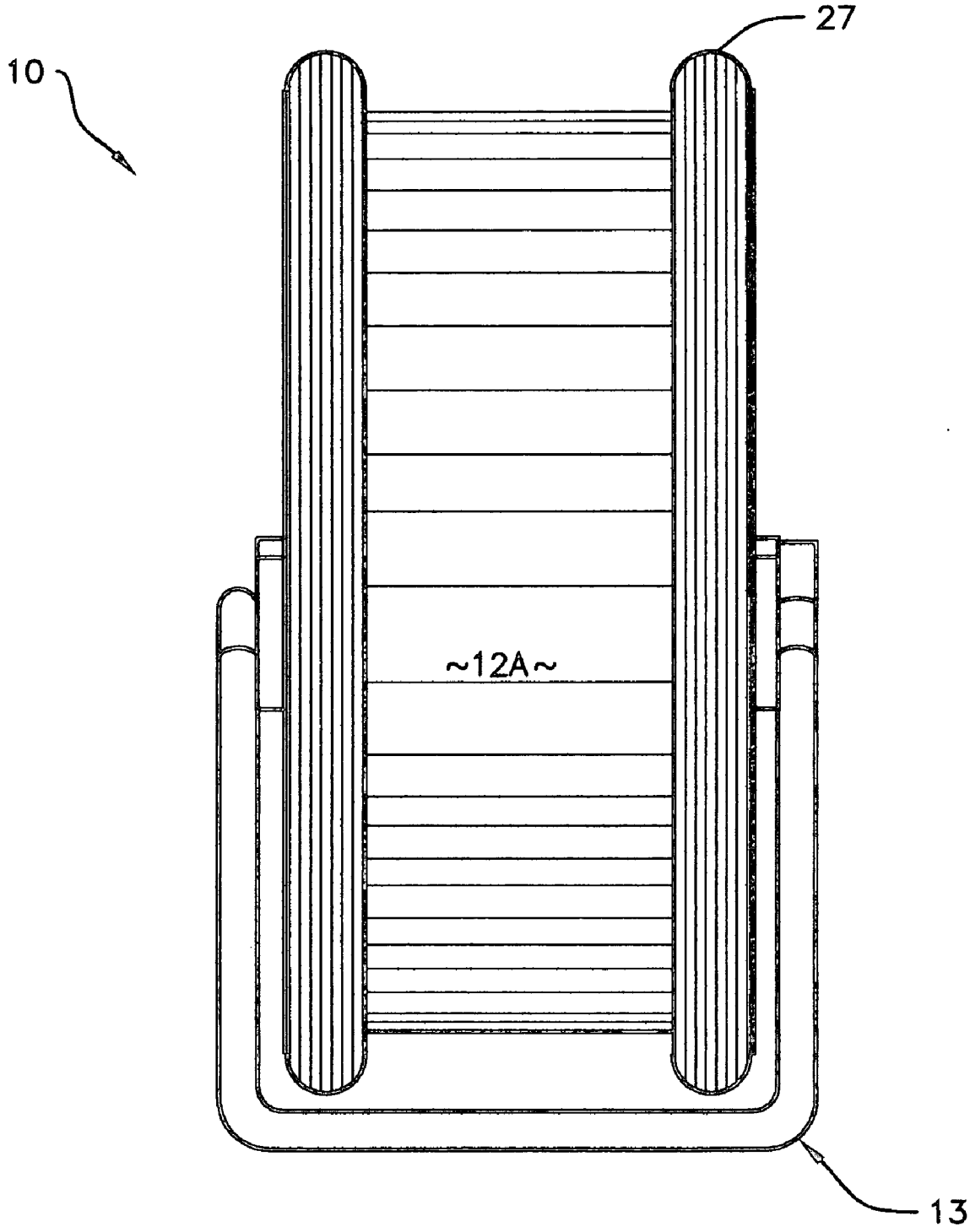
FIG. 10 is an end view taken from a position to the right of FIG. 9.

The fan interior 11 (FIGS. 9, 14) is protected at both ends by suitable circular, wire-mesh guards 23 (i.e., FIG. 1). Adequate guards may be of the snap-on variety described in my U.S. Pat. No. 5,944,448, or they may require mounting with conventional fasteners (i.e., screws) according to my U.S. Pat. No. 5,480,282. Each guard 23 preferably supports a central bearing coaxial with the center of rotation 19 that is coupled to the handle 13, so that housing 12 can rotate relative to the handle. The outer, peripheral surface 12A (i.e., FIGS. 1, 10) of housing 12 has a pair of resilient, tires 27 formed on its opposed edges that protect surface 12A from impact or abrasion during rolling. These concentric and spaced-apart tires 27 can be formed from elongated plastic or rubber hoses that are tensioned about the circumference of the housing 12, and internally fastened together by suitable clips.

Handle 15 is preferably symmetrical, comprising a pair of mirror image sides that are coupled about the housing 12. Each handle side has a triangular configuration. The fan housing is thus rotatably mounted in between handle sides. Each side half comprises an elongated arm 30 joined to a shorter foot 32 with an arcuate segment 33 (FIG. 9) that forms the apex of the "triangular" handle. Web 35 (FIG. 8) braces the arm 30 and foot 32. Since arm 30 is longer than the foot 32 it projects away from the housing 12 for user-access. Handle sides are connected by transverse joining portions 36 spanning the twin side portions 30 and/or 32 by suitable bent elbows 37, 38 (FIG. 15).

Figure 8:
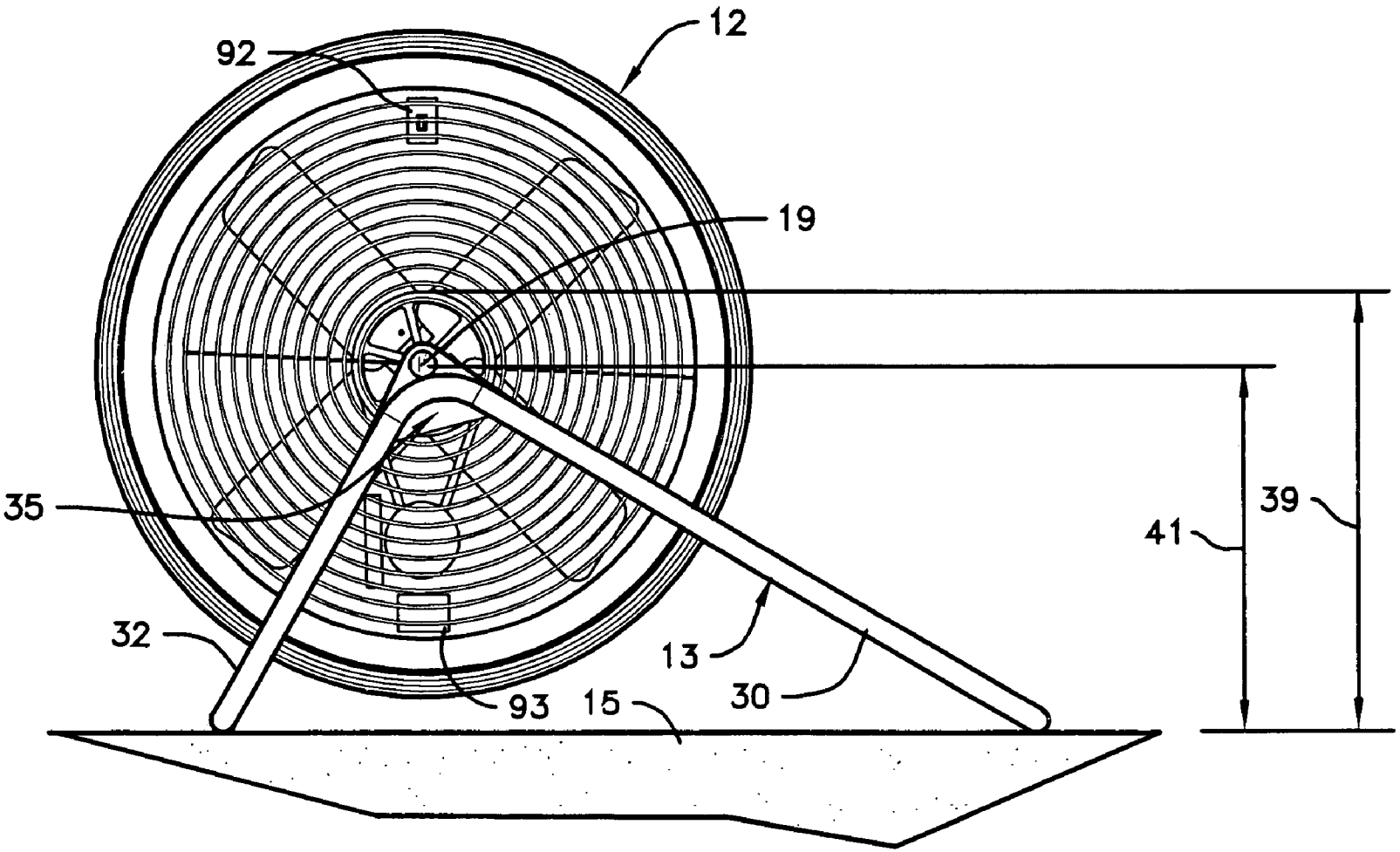
FIG. 8 is an elevational view of the fan disposed in an operative position.

Referring to FIG. 8, the center of rotation 19, which is located in the middle of web 35 at the apex of the triangle formed by the handle 13. The distance represented by arrow 41 (FIG. 8) between the center of rotation 19 and supporting surface 15 is varied by placement of the handle relative to the barrel. The altitude of the "triangle" formed by the fan when deployed (as in FIG. 8), represented generally by the arrow 41 (FIG. 8) is preferably greater than the housing radius and smaller than distance 39, which is the driven pulley height.

Figure 2:
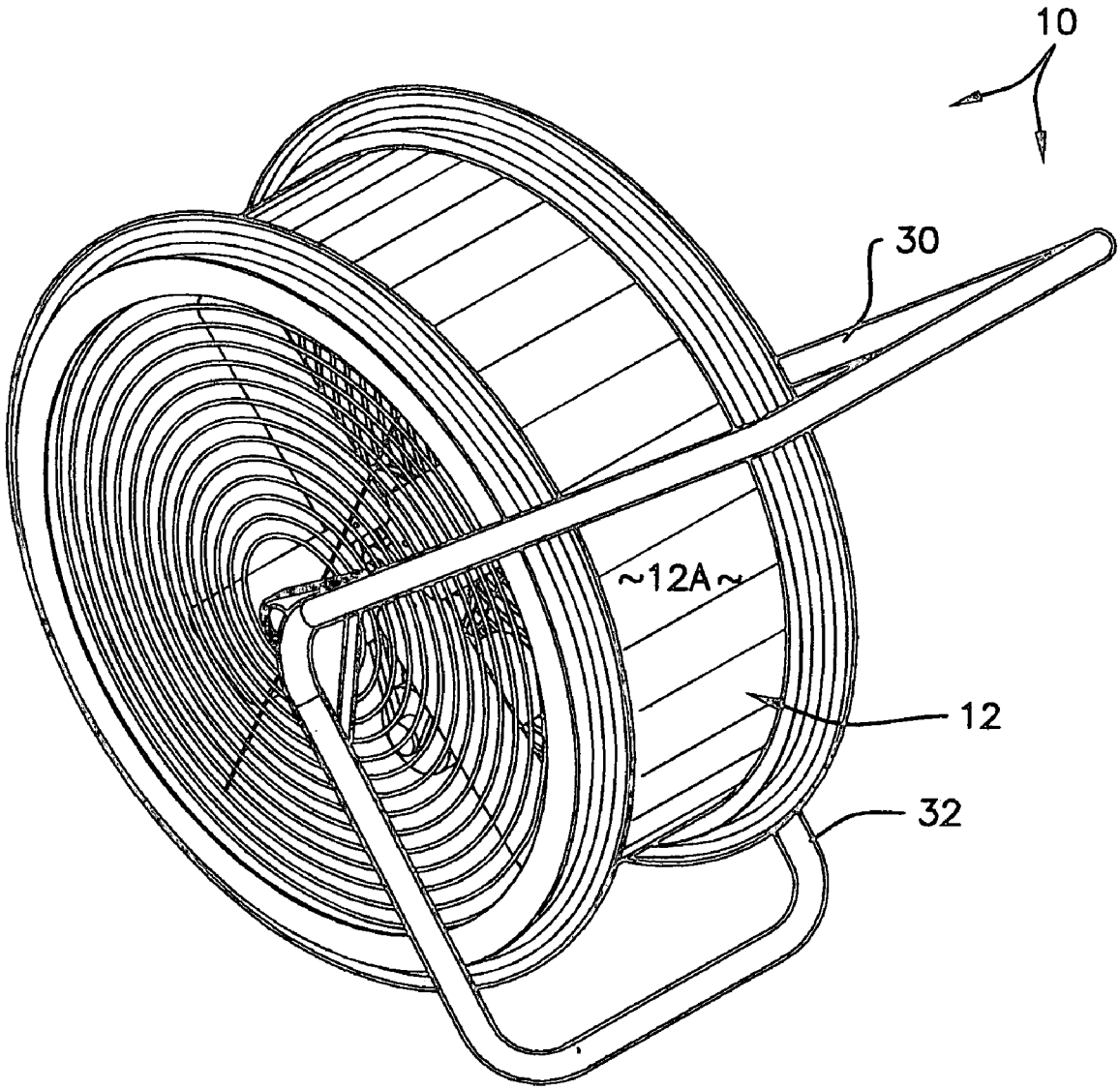
FIG. 2 is an isometric view similar to FIG. 1 but showing the fan disposed in a temporary storage position.
Figure 6:
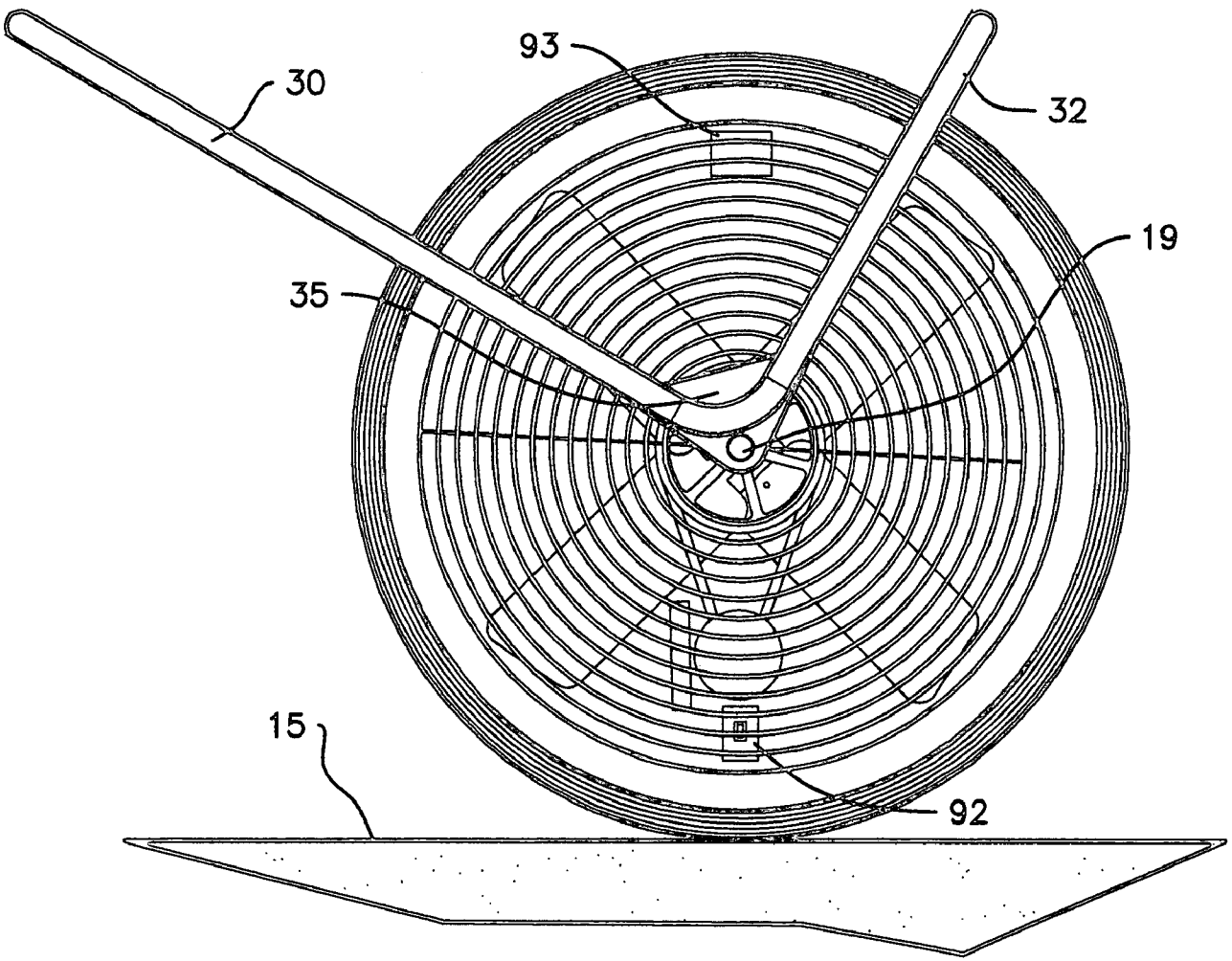
FIG. 6 is an elevational view of the fan of FIG. 1, showing it in a transportable orientation.
Figure 7:
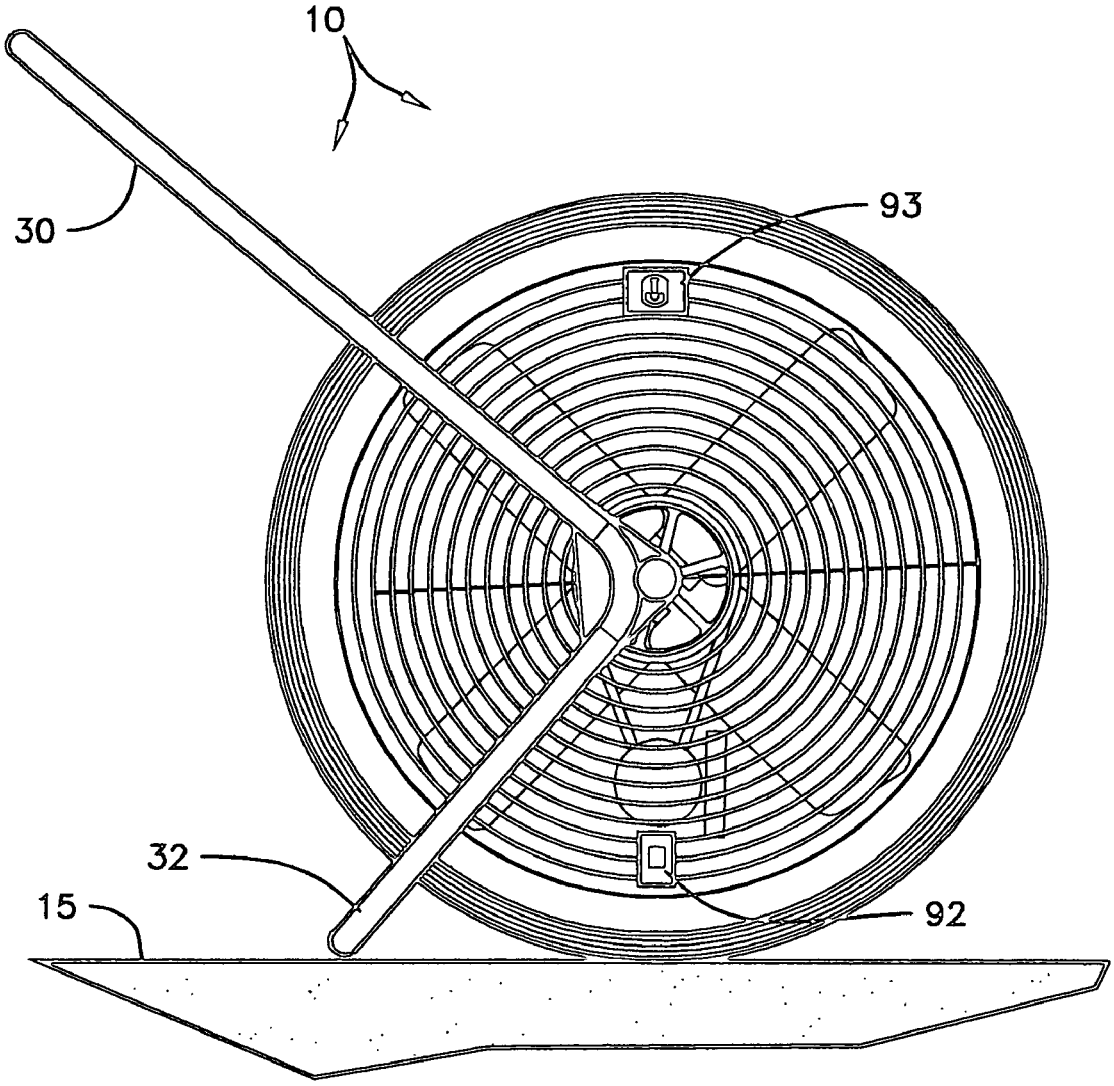
FIG. 7 is an elevational view of the fan disposed in a pre-operative orientation.

As seen in FIG. 1, handle arms 30 are manipulated by grasping side cross piece 36 to roll the fan 10 to a desired location over surface 15. At this time the open side of the triangle is aimed upwardly as in FIG. 6. When it is desired to temporarily store the fan, the handle is manipulated to the position of FIGS. 2 and 7, wherein the fan is supported by contact of the tires with the supporting surface 15 and the projecting handle feet portions 32 (FIG. 7).

The fan is operationally deployed as illustrated in FIG. 3, at which time the handle 13 is inverted from the transport orientation seen in FIG. 1. The center of rotation is elevated above surface 15 by selecting the distance represented by arrow 41 (FIG. 8) such that the radius of the housing 12 is cleared, i.e. the housing does not touch the ground. Instead, the housing is supported above ground by the triangle apex, with support generated by handle arms 30 and feet 32. Electrical operation is aided by on-off switch 92 and electrical connector 93 (FIG. 6) that deliver A. C. power to the internal fan motor.

Figure 4:
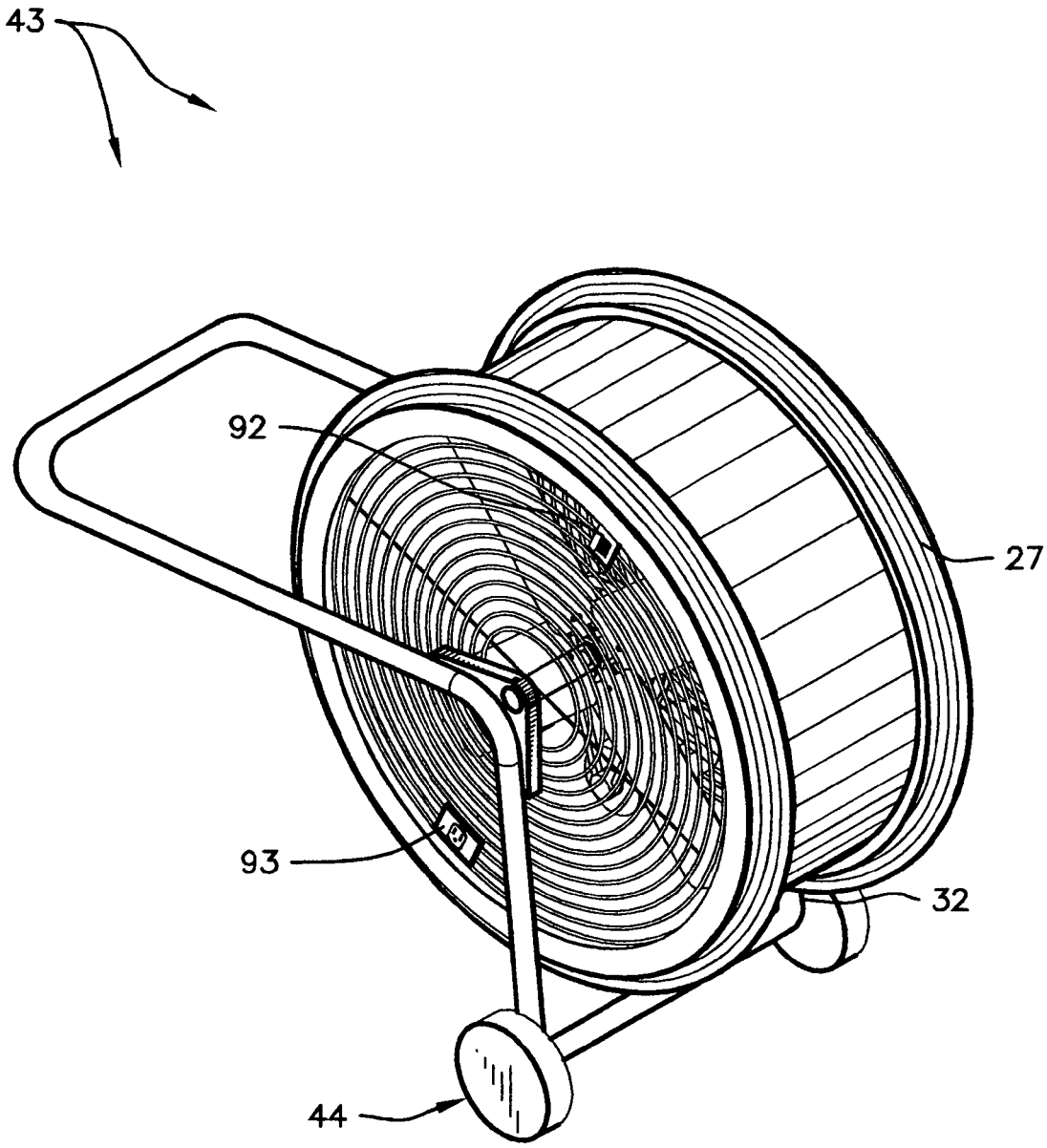
FIG. 4 is an isometric view showing an alternative embodiment.

Turning to FIG. 4, and alternative fan design 43 is shown. A set of auxiliary wheels 44 is connected to the lowermost portions of handle foot portions 32. These auxiliary wheels may be quick-connected to handle 13 for use when moving the fan 43 over dirty or wet areas, to prevent damage to the fan housing. Once a desired operation location is reached, the wheels may be removed and separately washed.

Figure 5:
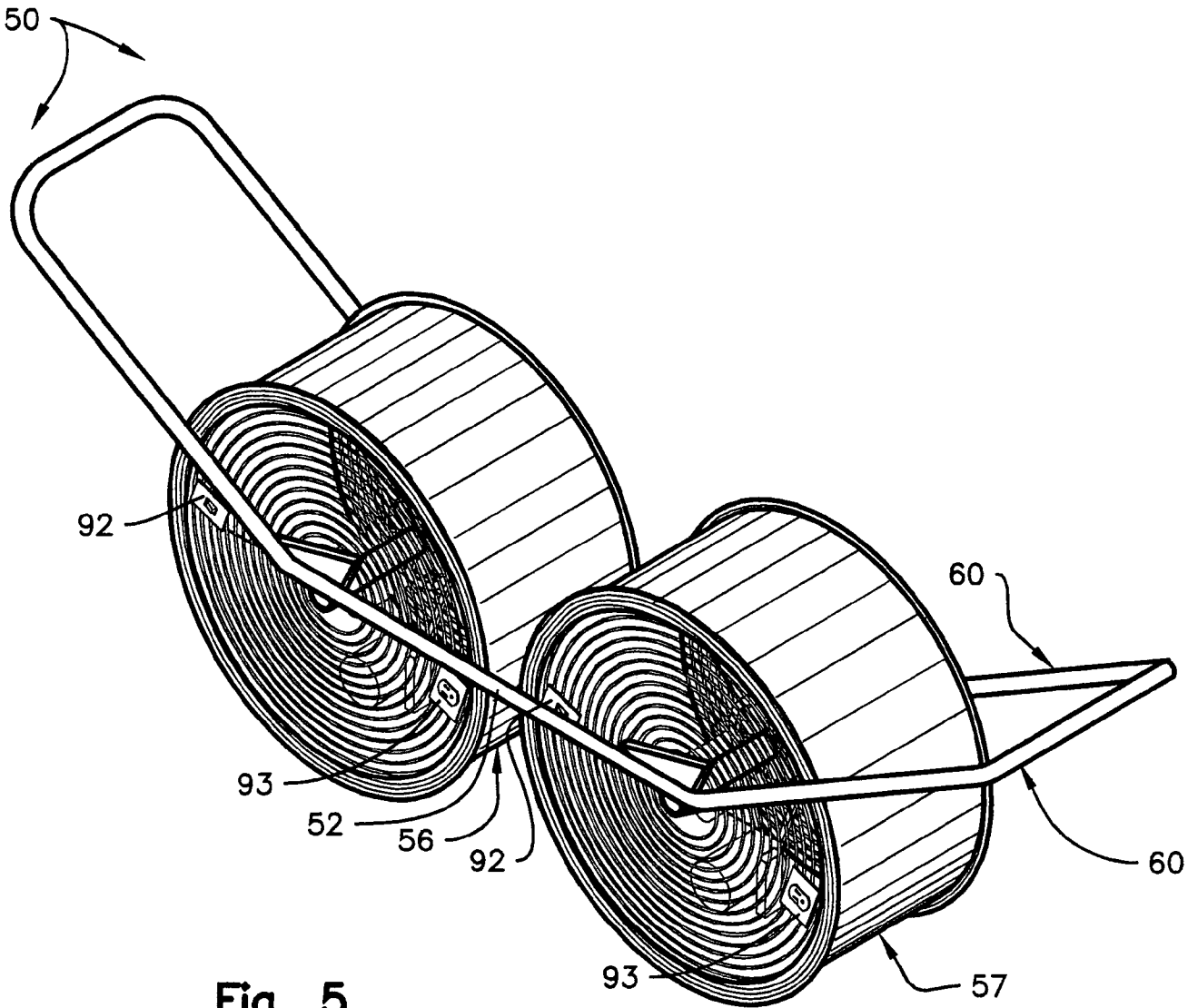
FIG. 5 is an isometric view of a second alternative embodiment.

In FIG. 5 an alternative tandom embodiment 50 is shown. A pair of fans 56, 57 are constrained between an enlarged handle 60 that has an elongated handle span 52. Once a desired location is reached, the arrangement is turned over in the manner described and the fans 56, 57 are disposed in a stable elevated position as before for ventilation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A fan comprising:

a rigid, rotatable drum-shaped housing having an interior and external circumference;

rotatable propeller means disposed within said housing interior for forcing air therethrough;

motor means within said housing interior for actuating said propeller means;

rigid handle means coupled to said drum-shaped housing for rolling the fan; and bearing means for rotatably coupling said handle means to said fan.

2. A fan comprising:

a rigid, rotatable drum-shaped housing having an interior and external circumference:

rotatable propeller means disposed within said housing interior for forcing air therethrough:

motor means within said housing interior for actuating said propeller means;

rigid handle means coupled to said drum-shaped housing for rolling the fan; and wherein the handle means can be rotated to an inverted position whereby it functions as a support stand during fan operation.

3. A fan comprising:

a rigid, rotatable drum-shaped housing having an interior and external circumference:

rotatable propeller means disposed within said housing interior for forcing air therethrough;

motor means within said housing interior for actuating said propeller means;

rigid handle means coupled to said drum-shaped housing for rolling the fan; and wherein the handle means has a V-shaped configuration with an apex to which the drum-shaped housing is mounted for rotation.

4. A fan comprising:

a rigid, rotatable drum-shaped housing having an interior and external circumference:

rotatable propeller means disposed within said housing interior for forcing air therethrough;

motor means within said housing interior for actuating said propeller means;

rigid handle means coupled to said drum-shaped housing for rolling the fan;

a recessed electrical plug to which electricity may be selectively applied after the fan is set up to operate the motor means; and wherein the handle means has a V-shaped configuration with an apex to which the drum-shaped housing is mounted for rotation that enables the handle to be inverted to function as a support stand during fan operation.

5. The fan as defined in claim 4 wherein the motor means is located near the fan bottom to stabilize and balance the fan.

6. A fan comprising:

a rigid, rotatable drum-shaped housing having an interior and external circumference;

rotatable propeller means disposed within said housing interior for forcing air therethrough;

motor means within said housing interior for actuating said propeller means;

rigid handle means coupled to said drum-shaped housing for rolling the fan; and wherein tires are formed about the external circumference of said housing.

7. The fan as defined in claim 6 wherein the motor means is located near the fan bottom to stabilize and balance the fan.

* * * * *